US005829543A

United States Patent [19]

Diaz

[11] Patent Number: 5,829,543

[45] Date of Patent: Nov. 3, 1998

[54] MOTORIZED IN-LINE BLADE ROLLER SKATE

[76] Inventor: Jose A. Diaz, 3200 NW. 79 St., Miami, Fla. 33147

[21] Appl. No.: 827,125

[22] Filed: Mar. 27, 1997

[51] Int. Cl.[6] ..... A63C 5/08

[52] U.S. Cl. ..... 180/181; 180/15; 180/221; 280/11.22; 280/11.27; 280/43.2

[58] Field of Search ..... 280/11.22, 11.27, 280/43.17, 43.2; 180/180, 181, 15, 16, 221, 295, 65.1

[56] References Cited

U.S. PATENT DOCUMENTS

| | | | |
|---|---|---|---|
| 1,603,588 | 10/1926 | Eberle | 280/7.13 X |
| 1,694,671 | 1/1928 | Rodelli | 180/181 |
| 2,578,886 | 12/1951 | Isherwood et al. | 180/221 |
| 2,857,008 | 10/1958 | Pirrello | 180/181 |
| 4,069,881 | 1/1978 | Shiber | 180/181 |
| 4,073,356 | 2/1978 | Schlicht | 180/181 |
| 4,418,784 | 12/1983 | Fox | 180/221 |
| 5,020,621 | 6/1991 | Martin | 180/181 |
| 5,127,488 | 7/1992 | Shanahan | 180/181 |

*Primary Examiner*—Brian L. Johnson
*Assistant Examiner*—Michael Mar
*Attorney, Agent, or Firm*—J. Sanchelima

[57] ABSTRACT

A motorized in-line blade roller skate having a longitudinally extending chassis plate with rear and front ends and several in-line blade roller members. A motor provides the necessary rotational movement that is transmitted through a cable to a gear assembly which in turn transmits it to a driving roller member. A bracket member is pivotally mounted to the rear end of the chassis plate and the driving roller member is rotatably mounted to the bracket. A clutch cable brings the driving roller member in contact with the rearmost roller member and thus transmitting the rotational movement to the latter. A second pivotally mounted bracket is provided for rotatably supporting the rear roller and is rigidly kept in place with, an adjustable linkage member. Adjusting this linkage member offset the wear and tear of the rear or driven roller and also permits a user to enhance gripping, preventing slip action, by bringing the rear roller member slightly below the plane defined by the other roller members.

4 Claims, 4 Drawing Sheets

MOTORIZED IN-LINE BLADE ROLLER SKATE

BACKGROUND OF THE INVENTION

1. Field of the Invention

The present invention relates to in-line blade roller skates.

2. Description of the Related Art

Applicant believes that the closest reference corresponds to U.S. Pat. No. 1,694,671 issued to M. Rodelli in 1927. However, it differs from the present invention because, from a practical standpoint, it requires the use of sprocket chain 51 which makes it very difficult to unmount the motorized assembly to permit a user to utilize the roller skate in a conventional manner. The present invention transmits the rotational movement by simply bringing the driving roller member in contact with the rear roller. Also, unless a complex clutch mechanism is introduced, the roller cannot be disengaged to allow the skate be free from the resistance of the motorized assembly. In the present invention, a user can selectively engage and disengage the motorized mechanism.

Other patents describing the closest subject matter provide for a number of more or less complicated features that fail to solve the problem in an efficient and economical way. None of these patents suggest the novel features of the present invention.

SUMMARY OF THE INVENTION

It is one of the main objects of the present invention to provide a motorized in-line roller blade that propels a user with a minimum of weight or discomfort.

It is still another object of this invention to provide a device that can be used as a motor brake to slow down the speed of a user.

It is another object of this invention to provide a device that avoids abrupt movements and that a user can control with ease.

It is still another object of the present invention to provide a device that can be readily mounted to roller skate and unmounted.

It is yet another object of this invention to provide such a device that is inexpensive to manufacture and maintain while retaining its effectiveness.

Further objects of the invention will be brought out in the following part of the specification, wherein detailed description is for the purpose of fully disclosing the invention without placing limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which.

DETAILED DESCRIPTION OF THE PREFERRED EMBODIMENT

Figure 1:
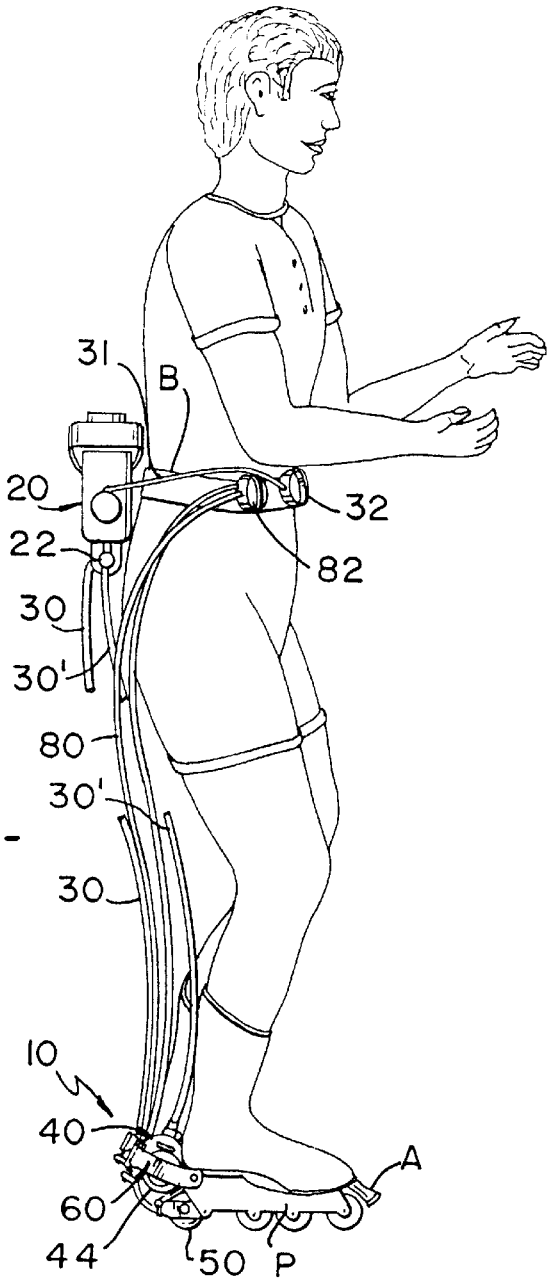
FIG. 1 represents a user skating with a motorized in-line blade roller.
Figure 5:
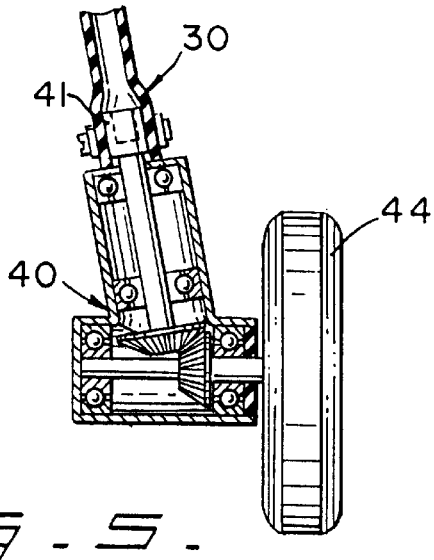
FIG. 5 represents a cross section of the meshing gear mechanism that transmits the rotational movement of the cable to the driving roller.
Figure 2:
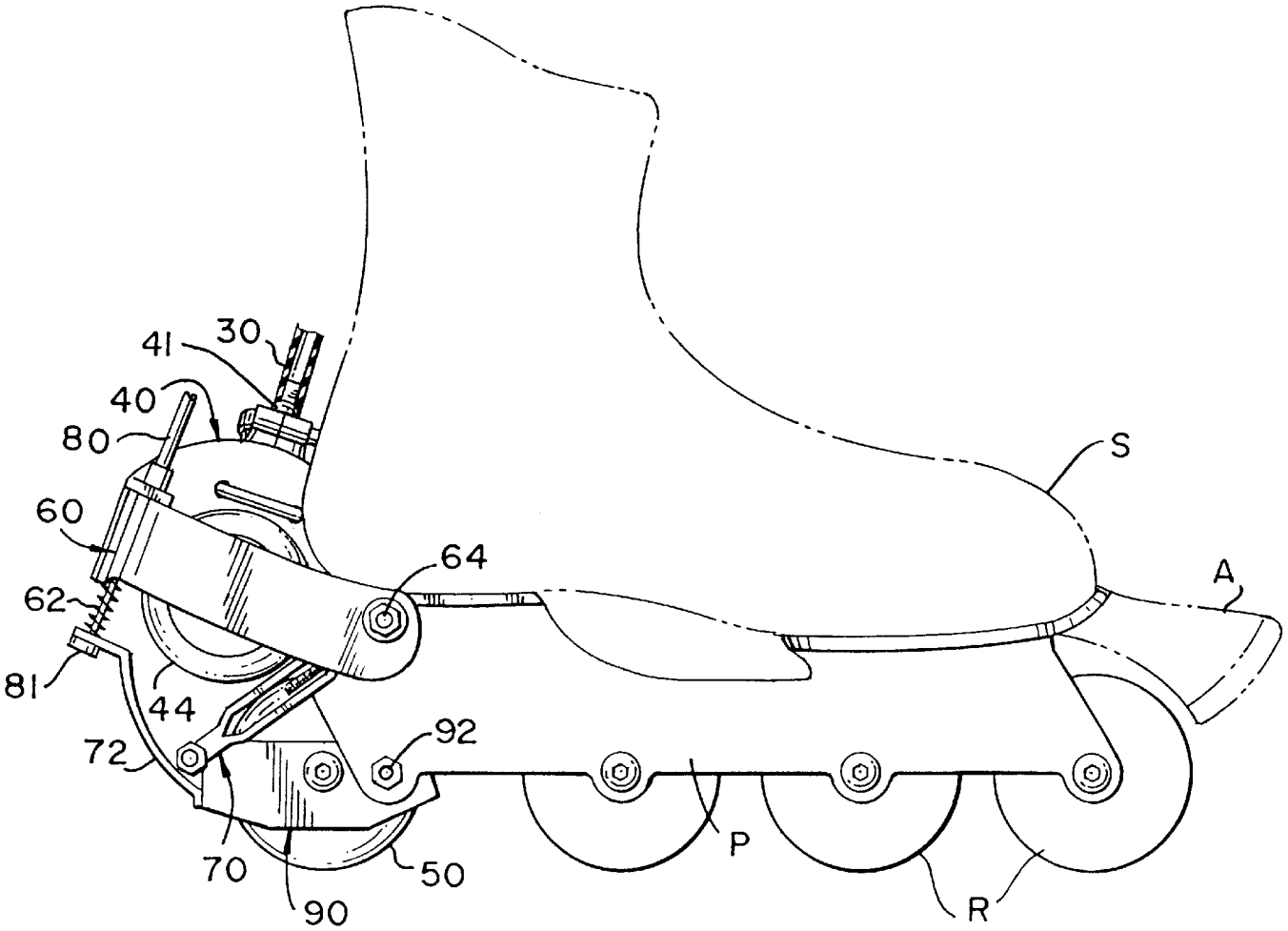
FIG. 2 shows a side elevational view of a skate incorporating the present invention.
Figure 3:
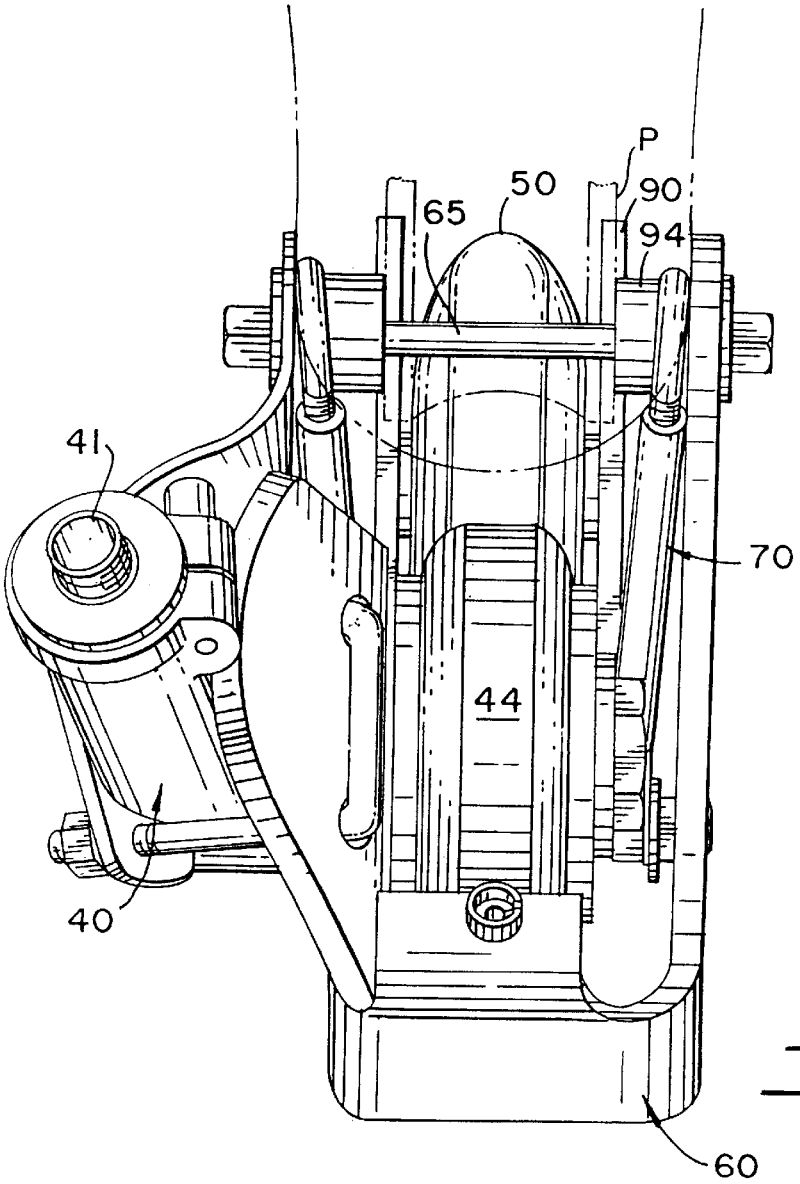
FIG. 3 illustrates a top view of the driving roller assembly mounted to the rear of a roller skate.
Figure 4:
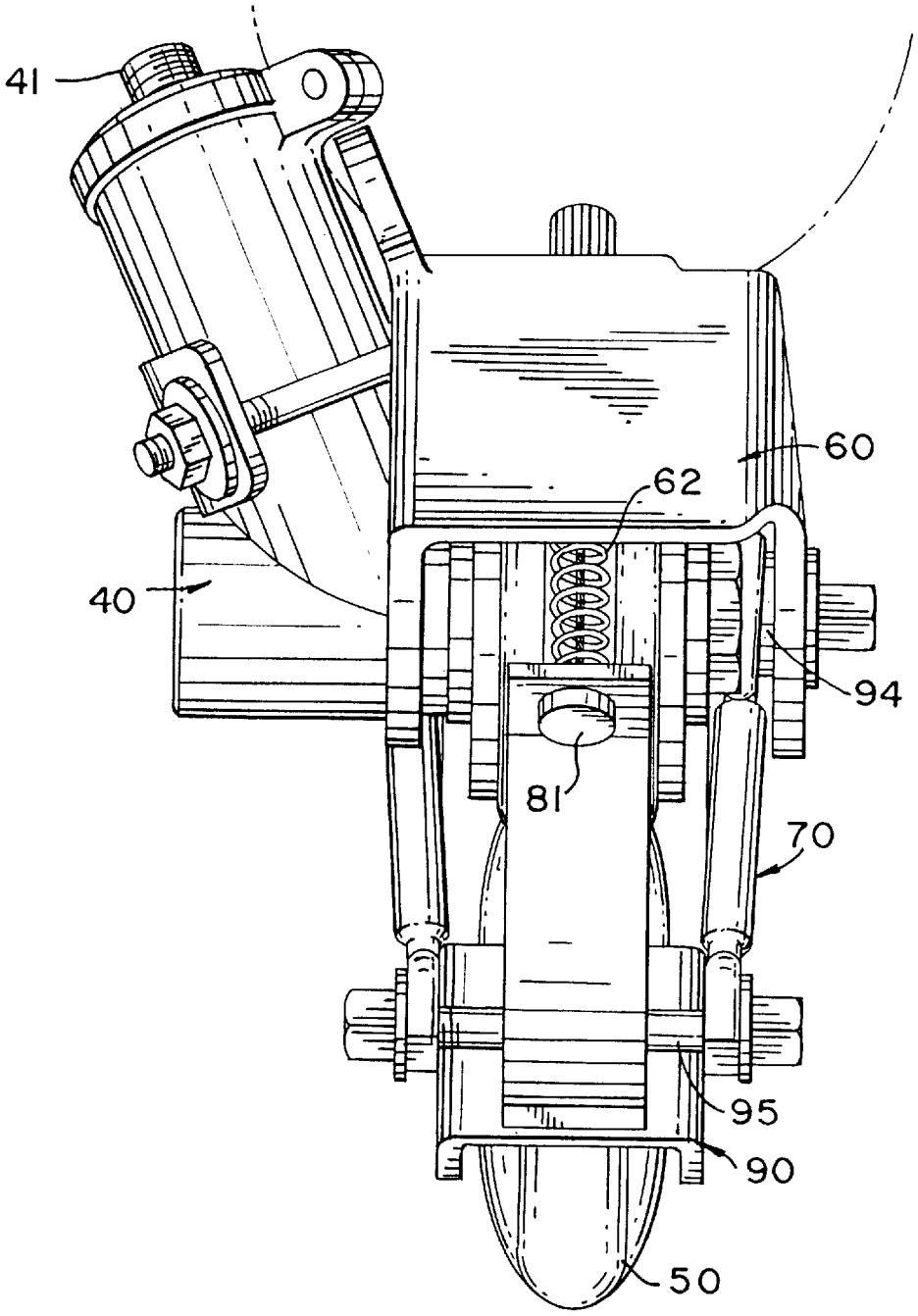
FIG. 4 is a representation of rear view of the driving roller assembly.

Referring now to the drawings, where the present invention is generally referred to with numeral 10, it can be observed that it basically includes motor assembly 20 and gear assemblies 40 and 40' (not shown) mounted to the rear of the chassis plates P of conventional in-line blade roller skates S. The rotational movement generated by motor assembly 20 is transmitted through cables 30 and 30'. The speed of motor assembly 20 is controlled with gas control knob 32 which is connected to the former through cable 31. Knob 32 is preferably mounted to a user's belt B. Gear assemblies 40 and 40' (not shown) receive the rotational movement from cable 30 and 30', which in turn is transmitted to driven roller 50 and 50' (not shown) of each skate S. The mechanism for each one of the two skates is identical so only one skate will be described.

Motor assembly 20, in the preferred embodiment, is implemented with a small internal combustion gas engine, such as the ones used with weed cutters and other small appliances. The rotational movement generated by motor assembly 20 is transmitted to T-gear assembly 22 from which the rotational movement is transmitted to one end of cables 30 and 30'. It is also possible, in operation, to use motor assembly 20 as a motor brake to slow down the speed of the skater.

The other end of cable 30 is connected to gear assembly 40 through port 41. Gear assembly 40 conveys the rotational movement to driving roller assembly 43, and in particular to driving roller 44, which is substantially similar to the conventional roller used in in-line roller skates S. Driving roller 44 is rotatably mounted to bracket assembly 60 which in turn is pivotally mounted to the upper rear end of chassis plate P of a conventional in-line roller skate S. Typically, conventional in-line roller skates have an opening at this point that is used to secure a rear brake pad similar to front brake pad A. Bracket assembly 60 is spring biased with spring member 62 urging driving roller 44 away from driven roller 50. Driven roller 50 is rotatably mounted within extension bracket assembly 90. Driven roller 50 may correspond to the rear roller in a conventional skate. If the rear roller is used as driven roller 50, it is susceptible to wear off rapidly. Any wear induces a larger rate or wear since the rear roller is not aligned with the rest of the rollers and it consequently slips. Therefore, it is desirable to use adjustable assembly 90 to keep driven roller 50 slightly below the rest of the rollers. Assembly 90 is pivotally mounted to rear end of chassis plate P through bolt 92. Assembly 90 is one way of implementing a mechanism for moving driven roller 50 (or rear roller) vertically, but other mechanisms may be used.

Clutch cable 80 is rigidly attached, at one headed end 81, to rigid arm 72. The other end of cable 80 is connected to knob assembly 82 that permits a user to retract and distend bracket assembly 60, and thus bringing roller 44 towards and away from roller 50. Bracket assembly 60 pivots about point 64 and it is biased by spring 62 urging driving roller 44 away from roller 50. When driving roller 44 comes in contact with driven roller 50, the rotational movement of the former is transmitted to the latter, as regulated by the user who actuates knob assembly 82.

Adjustable linkage assembly 70 permits a user to align driven roller 50 slightly below the rest of the rollers R as roller 50 is worn down. Assembly 70 is implemented, in the preferred embodiment, with a turn buckle that is mounted, at one end, to pin 65 through rubber cylinder 94 which acts as a shock absorber. The other end of assembly 70 is mounted to pin 95 so that extension bracket assembly 90 is kept in place and angularly adjusted by turning the turn buckle. It has been found that the best results (less wear) are obtained when roller 50 is brought slightly (about ⅛ of an inch) below the line of contact defined by the rest of the rollers. Otherwise, if roller 50 is not in contact with the surface it slips (burns) wearing off substantially faster. That is the reason for extension bracket assembly 90 which ensures more firm grip. Otherwise, and for relatively slow speeds, roller 44 could drive a conventional positioned rear roller. However, it has been found that without the means for adjusting the rear roller below the line of the rest of the rollers, most rear rollers do not last more that 5 miles without considerable wear. Extension bracket assembly 90 is pivotally mounted to bolt 92 and rigidly kept in place with co-acting linkage assembly 70. Rigid arm 72 extends rearwardly from bracket assembly 90 to provide a reference point for headed end 81 so when clutch cable 80 is pulled, bracket assembly 60 is brought towards driven roller 50.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. A motorized in-line roller skate having a longitudinally extending chassis plate having rear and front ends and having a plurality of in-line roller members including a rear roller member comprising:

A) motor means for supplying rotational movement;

B) cable means for transmitting said rotational movement having first and second ends, said first end being connected to said motor means;

C) a driving roller assembly connected to said second end, and including a driving roller member to which said rotational movement is transmitted and further including a bracket assembly pivotally mounted to said rear end and said driving roller member being rotatably mounted within said bracket assembly;

D) means for moving said bracket assembly towards and away from said rear roller member so that said driving roller member can be selectively brought in contact with said rear roller member.

E) an extension bracket assembly for mounting said rear roller member to said chassis plate which includes an extension bracket pivotally mounted to a rearmost roller mounting opening formed in said chassis plate, said rear roller member being rotatably mounted within said extension bracket, and means for adjusting and maintaining a selected pivotal alignment of said extension bracket relative to said chassis plate so that the relative vertical position of said rear roller member with respect to the other roller members can be adjusted to compensate for a reduction in diameter of said rear roller member caused by wear.

2. The roller skate set forth in claim 1 further including:

gear means for transmitting the rotational movement of said second end to said driving roller member.

3. The roller skate set forth in claim 2 wherein said driving roller assembly includes spring means for biasing the position of said driving roller member with respect to said rear roller member.

4. The roller skate set forth in claim 3 wherein said bracket assembly is removably mounted to said rear end.

* * * * *